United States Patent [19]

Long et al.

[11] Patent Number: 4,505,646

[45] Date of Patent: Mar. 19, 1985

[54] EDUCTOR PUMP AND PROCESS

[75] Inventors: Nathan R. Long, Grosse Ile; Howard L. Anderson, Southgate, both of Mich.

[73] Assignee: Diversey Wyandotte Corporation, Wyandotte, Mich.

[21] Appl. No.: 441,607

[22] Filed: Nov. 15, 1982

[51] Int. Cl.[3] ..... F04F 5/00

[52] U.S. Cl. ..... 417/172; 417/178

[58] Field of Search ..... 417/172, 181, 178, 195, 417/198, 360, 183, 454, 555 R, 555 A; 137/855, 856, 857, 858

[56] References Cited

U.S. PATENT DOCUMENTS

| | | | |
|---|---|---|---|
| 1,693,101 | 11/1928 | Worthington | 417/172 X |
| 2,029,457 | 2/1936 | Beardmore | 417/172 X |
| 2,178,898 | 11/1939 | Schellin et al. | 417/183 |
| 2,489,636 | 11/1949 | Gurley | 417/172 |
| 3,062,149 | 11/1962 | Jacuzzi | 417/172 X |
| 3,799,299 | 3/1974 | Cohen | 137/855 X |
| 3,955,901 | 5/1976 | Hamilton | 137/855 X |

*Primary Examiner*—Edward K. Look

*Attorney, Agent, or Firm*—Marshall, O'Toole, Gerstein, Murray & O'Toole

[57] ABSTRACT

An eductor pump for withdrawing a feed liquid from a container, comprising a tubular body having a venturi element mounted inside and near the lower end of the tubular body; a conduit for feeding a drive liquid to the venturi element so that the drive liquid can flow through the venturi element and be directed upwardly in the tubular body; a feed liquid access opening in the closed lower end of the tubular body and a passageway from said access opening to the upstream side of the venturi element whereby feed liquid can be inspirated into upward flow, and admixture with, a stream of drive liquid flowing out of the venturi element; an outlet to remove a mixed stream of feed liquid and drive liquid from the upper part of the tubular body; and a one way valve mounted in the feed liquid access opening.

9 Claims, 18 Drawing Figures

EDUCTOR PUMP AND PROCESS

This invention relates to an improved eductor pump. More particularly, this invention is concerned with an eductor pump for withdrawing liquids, including pure liquids, solutions, dispersions and suspensions, from a storage container.

BACKGROUND OF THE INVENTION

Eductors are widely used in pumping liquids and gases because they are relatively simple to build and operate, and because they are largely free of mechanical breakdowns. An eductor pump essentially comprises a venturi element through which a driving fluid is passed at an appropriate flow rate to create a reduced pressure space around the venturi outlet. A feed fluid, which it is desired be pumped, is permitted to flow freely by gravity or by application of pressure, to the reduced pressure space where it is inspirated and propelled with the driving fluid as a mixture therewith. The pumping efficiency of the eductor will depend on the driving liquid flow rate, the viscosity of the driving liquid and the feed liquid, the size and shape of the venturi element and other factors, all of which is known to those skilled in the art.

Recently, W. J. Haggard U.S. Pat. No. 4,298,018 disclosed use of an eductor pump for pumping viscous liquids, such as a detergent slurry, from a storage container. The feed liquid inlet at the bottom of the pump is continually open so that feed liquid can flow in and out. This is considered desirable since the pump is to be used on an intermittent cycle with water as the driving liquid. During intermittent pumping, detergent slurry is pumped by use of water flowing through the venturi element. Pumping is then stopped for a short time so that water mixed with detergent slurry can flow out the pump lower end and dilute the slurry in the immediate vicinity. Such diluting is effected during a pumping cycle as well as after a cycle is effectively completed.

The eductor pumping method of W. J. Haggard, while possibly of value for pumping viscous slurries, is generally unsuitable for pumping low viscosity slurries, suspensions, solutions or pure liquids where dilution in the container of the feed liquid is unnecessary or undesirable. A need accordingly exists for an improved eductor pump which will bar feed liquid which enters the pump body from flowing outwardly through the feed liquid inlet, whether or not diluted by driving liquid.

SUMMARY OF THE INVENTION

According to the invention, an eductor pump for withdrawing a feed liquid product from a container is provided comprising a tubular body with a closed lower end having a converging nozzle mounted inside and near the lower end of the tubular body; conduit means for feeding a drive liquid to the converging nozzle so that the drive liquid can flow through the converging nozzle and be directed upwardly in the tubular body; a feed liquid access opening in the closed lower end of the tubular body and a passageway from said access opening to the upstream side of the converging nozzle whereby feed liquid can be inspirated into upward flow, and admixture with, a stream of drive liquid flowing out of the converging element; means to remove a mixed stream of feed liquid and drive liquid from the upper part of the tubular body; and a one way valve mounted in the feed liquid access opening which lets feed liquid in when drive liquid flows through the converging nozzle but closes when drive liquid flow through the venturi element is stopped. A valve retaining element is desirably employed to keep the valve from being removed when liquid flows through it with loss of valving action.

The one way valve is desirably a flapper valve, which can be made of a rubber-like material. It can include a peripheral circular ring, which fits snugly in the feed liquid access opening, a closing portion within the ring which rests on a seat when the valve is closed, and a thin membrane hinge integral with the ring and the closing portion which permits the closing portion to rotate upwardly to let feed liquid flow in, and rotate downwardly to seat and close the access opening as a result of liquid in the tubular body pressing on the top of the flapper valve when there is no drive liquid flow through the converging nozzle.

More specifically, the invention provides an eductor pump for withdrawing a feed liquid product from a container comprising a tubular body having a converging nozzle mounted inside and near the lower end of the tubular body; conduit means for feeding a drive liquid to the converging nozzle so that the drive liquid can flow through the converging nozzle and be directed upwardly in the tubular body; a feed liquid access opening in the lower end of the tubular body and a passageway from said access opening to the upstream side of the converging nozzle whereby feed liquid can be inspirated into upward flow, and admixture with, a stream of drive liquid flowing out of the converging nozzle; means to remove a mixed stream of feed liquid and drive liquid from the upper part of the tubular body; a removable plate, having top and bottom surfaces, attached to the lower end of the tubular body; a hole through the plate communicating with the feed liquid access opening in the tubular body lower end, with said hole having a greater diameter in the upper part than in the lower part of the plate thereby providing a valve supporting ledge in the hole; and a flapper valve mounted in the hole in the plate on the valve supporting ledge.

The flapper valve can be made of a rubber-like material and include a peripheral circular ring, which fits snugly in the hole, a hole closing portion within the ring which rests on the ledge when the valve is closed, and a thin membrane hinge integral with the ring and the hole closing portion which permits the hole closing portion to rotate upwardly to let feed liquid flow by, and rotate downwardly and seat on the ledge as a result of liquid in the tubular body pressing on the top of the flapper valve when there is no drive liquid flow through the converging nozzle. Furthermore, the flapper valve hole closing portion can have a flat bottom and a domed top.

The plate bottom surface can have a planar portion lateral to the plate axis and a planar portion sloped about 15° to 30° from a plane normal to the plate axis to keep the liquid feed access hole from being blocked by contact with a container bottom. The sloped planar portion desirably intersects the lateral planar portion across the hole to assure liquid feed access to the hole. Liquid access to the hole is further facilitated when the sloped planar portion is provided with a groove therein extending to the hole so that feed liquid can enter the hole along the groove.

The plate desirably is circular, the plate upper surface is provided with a circular groove, and an O-ring is positioned in the groove and contacts the lower end of the tubular body in sealing contact.

BRIEF DESCRIPTION OF THE DRAWINGS

DETAILED DESCRIPTION OF THE DRAWINGS p To the extent it is reasonable and practical, the same elements which appear in the various views of the drawings will be identified by the same numbers.

FIG. 1 shows an eductor pump 10 according to the invention positioned in open-top container 200 which contains feed liquid 202. The eductor pump 10 shown in FIGS. 1 to 3 has an internal tubular body 12 axially positioned inside of exterior conduit or tubular member 14. The upper end 17 of conduit 14 fits tightly into an axial recess in cap member 16. Ring 18 is mounted around tubular member 14 adjacent the bottom of cap member 16 and provides a mechanical means which prevents the eductor pump from going completely through an outlet hole in the top of a closed container.

Figure 1:
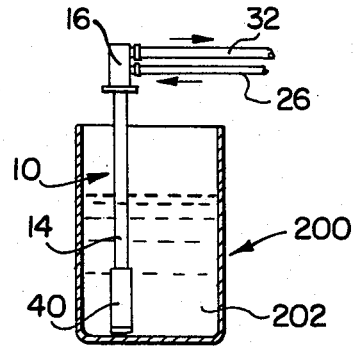
FIG. 1 is an elevational view of an eductor pump constructed according to the invention, positioned in a container shown in section.
Figure 2:
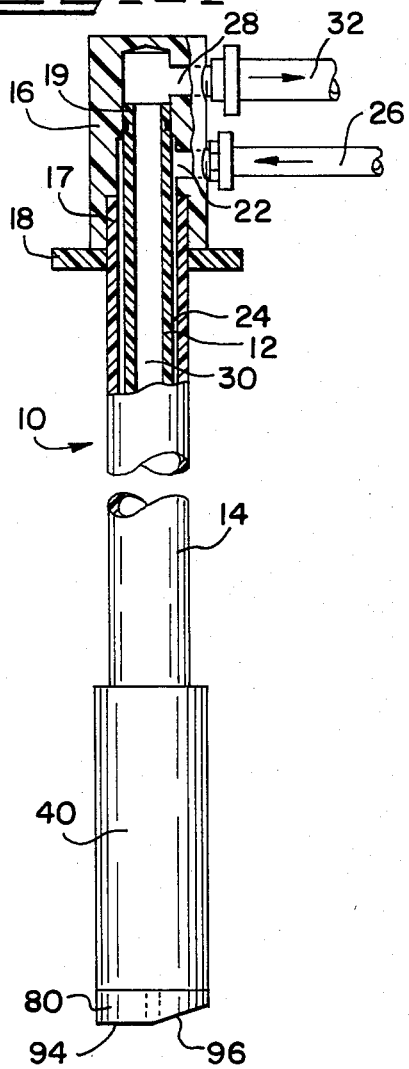
FIG. 2 is an elevational view of the eductor pump of FIG. 1 with the upper portion shown in vertical section.

The upper end 19 of tubular body 12 also fits tightly in an axial recess in cap member 16. Hole 22 is provided in cap member 16 and it communicates with a drive fluid flow space 24 between the exterior surface of tubular body 12 and the interior surface of conduit 14. Flexible hose 26 is placed in communication with hole 22 by a suitable fitting (FIGS. 1 and 2).

Hole 28 is located in the upper part of cap member 16 and it communicates with the interior 30 of tubular body 12. The tube interior 30 provides a flow path for a mixed stream of feed liquid and drive liquid. The mixed liquid stream is removed through flexible hose 32 which is placed in communication with hole 28 by a suitable fitting (FIGS. 1 and 2).

Figure 3:
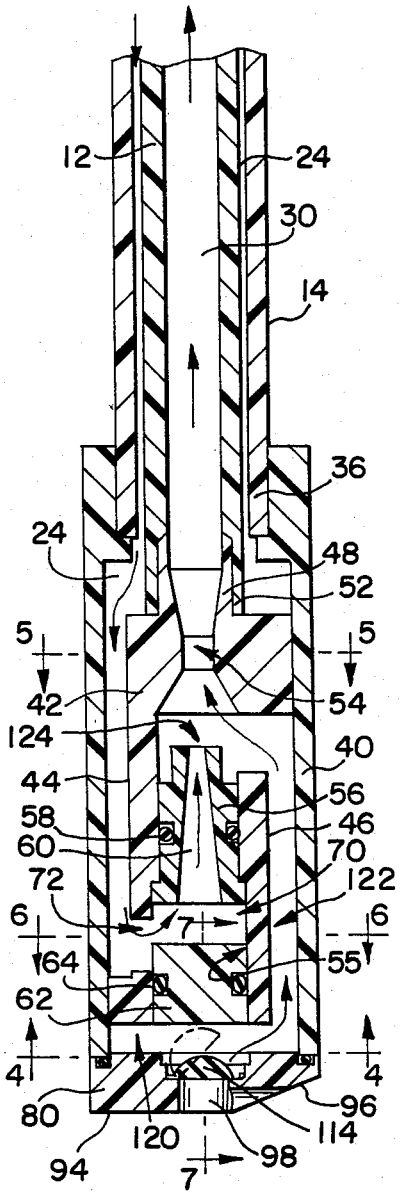
FIG. 3 is a vertical sectional view through the lower portion of the eductor pump shown in FIGS. 1 and 2.
Figure 4:
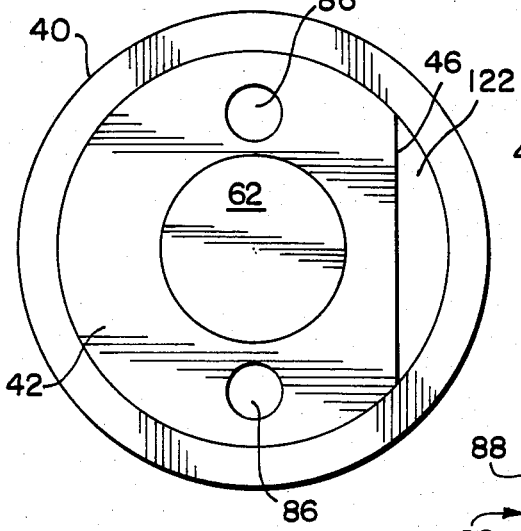
FIG. 4 is a view of the bottom of the pump, taken along the line 4—4 of FIG. 3, with the removable valve-containing plate removed.

The lower end 36 of tubular member 14 fits tightly and axially into the upper end of tubular shell 40 (FIG. 3). Located fixedly inside of and in contact with tubular shell 40 is a more or less cylindrical block 42 having opposing vertical flat sides 44 and 46. Flat side 44 extends downwardly from the top but terminates short of the bottom of block 42. Also, flat side 46 extends upwardly from the bottom but terminates short of the top of block 42. The upper end of cylindrical block 42 has a protruding nipple 48 over which the lower end 52 of tubular body 12 fits in axial arrangement.

The internal upper portion of block 42 is drilled out to provide a nozzle opening 54 (FIG. 3). The lower and central portions of block 42 contain an axial bore 55 into which insert 56 is secured in fluid-tight arrangement using O-ring 58. Insert 56 (FIG. 3) contains a venturi shaped truncated conical bore 60 with the smallest diameter at the upper end of the insert 56. Plug 62 having O-ring 64 fits tightly in the lower end of bore 55 in block 42. The top of plug 62 is spaced downwardly from the lower end of insert 56 to provide a space 70 into which drive liquid can flow through lateral hole 72 (FIG. 3) in block 42.

Figure 7:
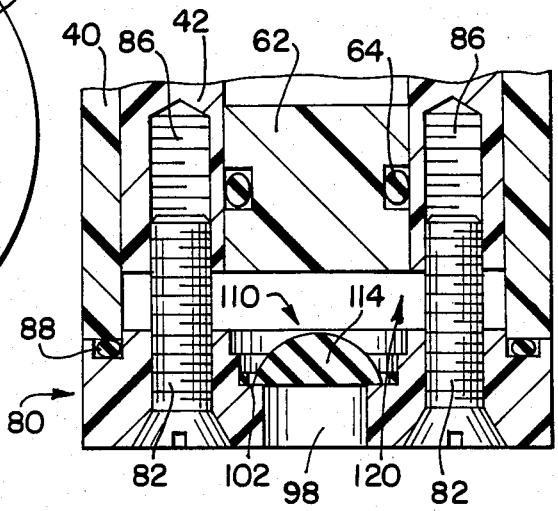
FIG. 7 is a sectional view taken along the line 7—7 of FIG. 3.
Figure 5:
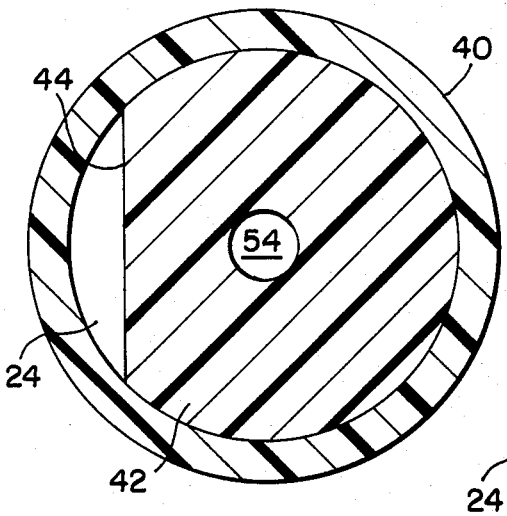
FIG. 5 is a sectional view taken along the line 5—5 of FIG. 3.
Figure 6:
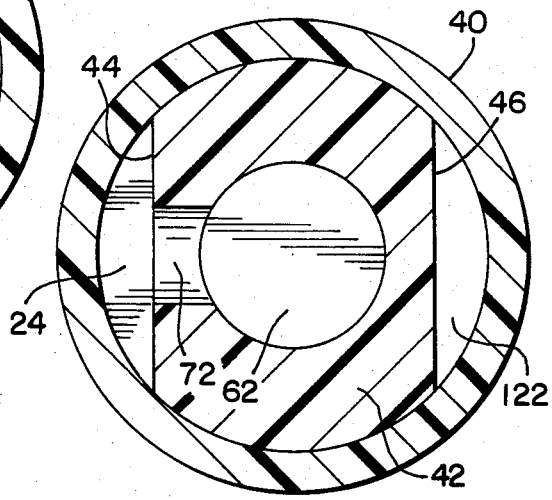
FIG. 6 is a sectional view taken along the line 6—6 of FIG. 3.

A plate 80, in the form of a disc, is removably mounted on the end of tubular shell 40 by means of two screws 82 (FIG. 7). The screws 82 extend through holes 84 in plate 80 into internally threaded holes 86 in the end of block 42. An O-ring 88 (FIGS. 12 and 13) is mounted in a circular groove in the top face of plate 80 so as to contact the lower edge of tubular shell 40 and produce a liquid tight joint.

Figure 8:
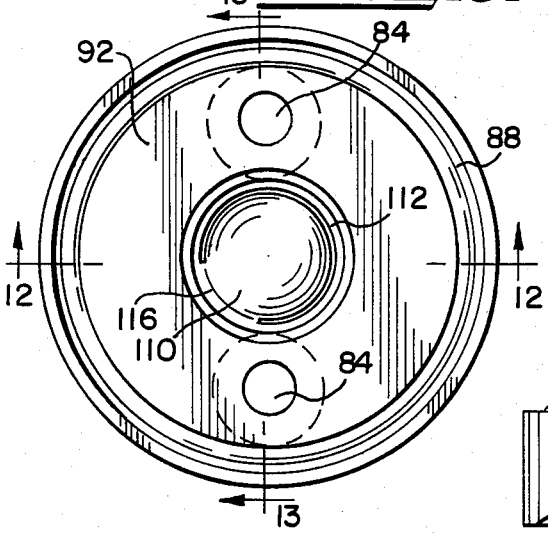
FIG. 8 is a top plan view of the removable valve-containing plate at the lower end of the eductor pump shown in FIGS. 1 to 7.
Figure 11:
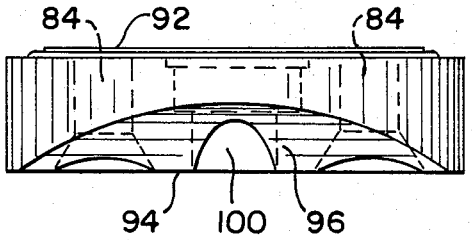
FIG. 11 is a front view of the plate shown in FIGS. 8 to 10.
Figure 9:
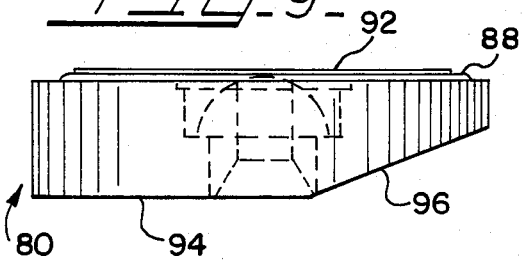
FIG. 9 is a side view of the plate shown in FIG. 8.
Figure 12:
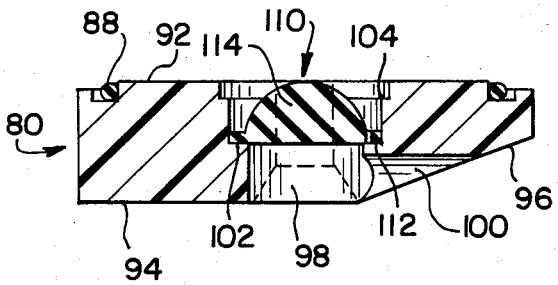
FIG. 12 is a sectional view taken along the line 12—12 of FIG. 8.
Figure 10:
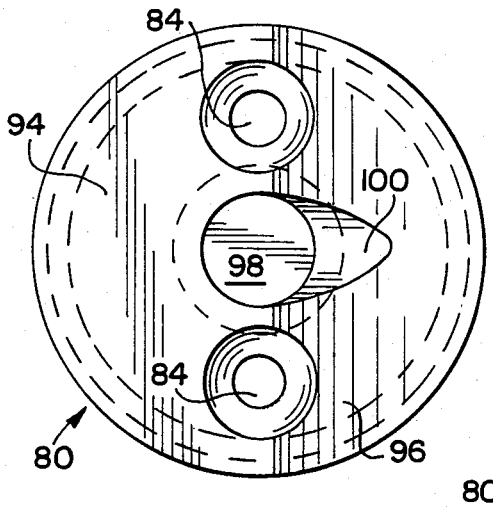
FIG. 10 is a bottom plan view of the plate shown in FIGS. 8 and 9.

Plate 80 has a flat top surface 92 and a flat bottom surface 94 parallel to top surface 92 (FIGS. 8 to 13). However, the bottom surface has a slanted or sloped surface 96 (FIGS. 9 and 12). An axially located hole 98 extends through plate 80. A horizontal groove 100 (FIGS. 10 to 12) with arced walls extending to hole 98 is provided in the sloped portion 96. In this way the hole 98 in the bottom of the plate cannot be sealed off regardless of the angle at which the plate bottom contacts another surface, such as the bottom of container 200 (FIG. 1). Hole 98 widens or enlarges twice as it extends upwardly, thereby providing ledges 102 and 104.

Figure 13:
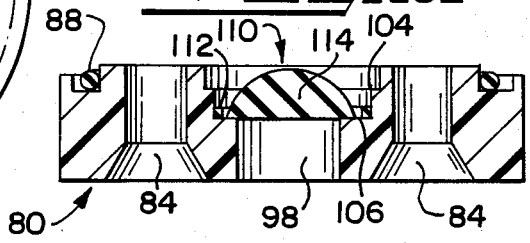
FIG. 13 is a sectional view taken along the line 13—13 of FIG. 8.
Figure 14:
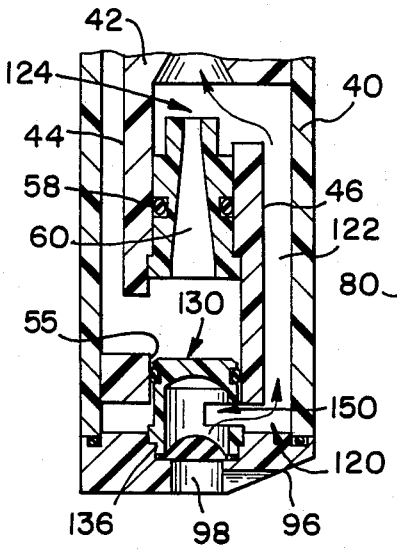
FIG. 14 is a vertical sectional view through the lower portion of an eductor pump according to the invention with a valve retaining element secured to the valve-containing plate.
Figure 15:
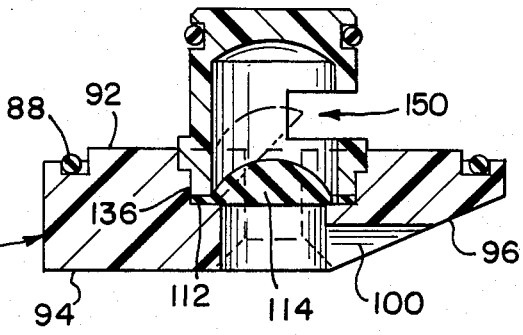
FIG. 15 is an enlarged sectional view of the valve retaining element in the valve-containing plate shown in FIG. 14.
Figure 16:
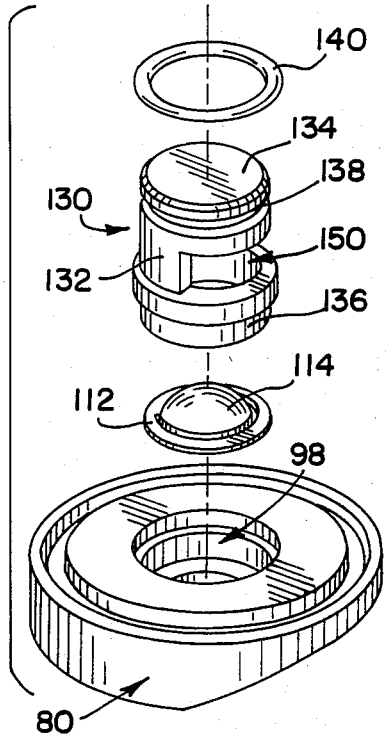
FIG. 16 is an exploded view of the valve retaining element, valve and valve-containing plate assembly with reference to FIGS. 14 and 15.
Figure 17:
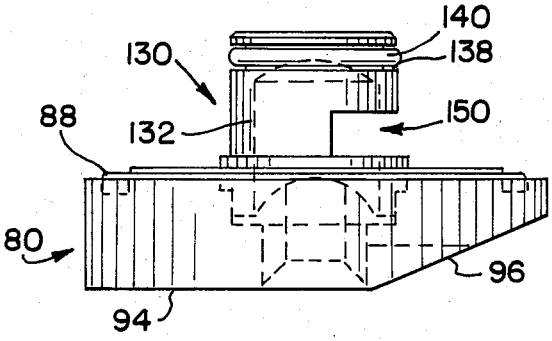
FIG. 17 is a side elevational view of the valve-containing plate assembly shown in FIGS. 14 to 16.
Figure 18:
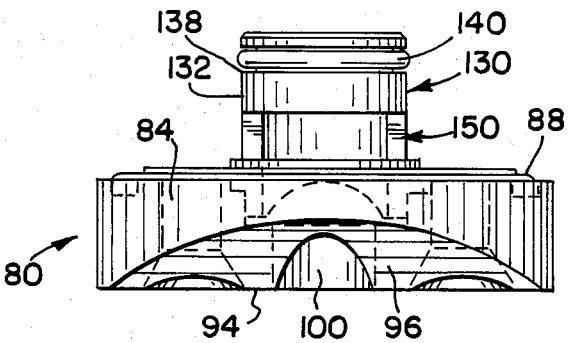
FIG. 18 is a front elevational view of the valve-containing plate assembly shown in FIGS. 14 to 17.

A rubber flapper valve 110 (FIGS. 3, 12 and 13) is snugly mounted in hole 98 so that the peripheral ring 112 of the valve rests on part of ledge 102, while providing enough room on the ledge for the outer edge of the flat bottom domed element 114 to also rest on the ledge when the valve is in closed position. The domed element 114 is integrally joined to ring 112 by a thin flexible membrane 116 which functions as a hinge (FIGS. 8, 12 and 13).

Space 120 (FIGS. 3 and 7) between the top of plate 80 and the bottoms of block 42 and plug 62 provides a flow path by which feed liquid which enters hole 98 and flows past valve 110 can enter passage 122 and flow into the space 124 above the outlet of converging nozzle 60

(FIG. 3). Space 120 also provides clearance for valve domed element 114 to hinge upwardly to fully open hole 98 for flow of feed liquid upwardly through the hole.

The components of the described eductor pump can be made of metal or a suitable polymeric material, except of course the O-rings and valve which are desirably made of rubber or rubber-like material. In general, an inert polymeric material is most suitably used for the pump components because such a material is easy to fabricate and is relatively inexpensive. Rigid polyvinyl chloride is especially useful for fabricating the pump.

The described eductor pump is used by placing it in a container 200 containing a feed liquid 202 to be removed from the container (FIG. 1). The feed liquid 202, for example, can be a concentrated aqueous detergent solution, dispersion or slurry. Water can then be supplied as the driving liquid through hose 26. The water flows through passage 24, through hole 72 into space 70 from which it enters venturi 60. The water exits the venturi at high speed into space 124, thereby developing a reduced pressure in space 124. The reduced pressure thereby created permits atmospheric pressure applied to the surface of feed liquid 202 in container 200 to be forced into hole 98 in plate 80 at the bottom of the pump. The force of the feed liquid moves the hinged domed element 114 upwardly thereby permitting the feed liquid to pass through the valve into space 120 and from it to space 122 from which it flows to space 124. At space 124 the feed liquid is propelled upwardly with the fast flowing stream of drive liquid (water) exiting from the converging nozzle 60. This creates an upwardly flowing mixture of the drive and feed liquids which flow through nozzle opening 54 into the interior 30 of tubular body 12 from which the liquid mixture flows out hole 28 into hose 32 for delivery to a suitable destination, such as a dishwashing machine.

When the drive liquid flow is stopped for any reason, the reduced pressure in space 124 is eliminated. The static force of the liquid in the pump forces domed element 114 downwardly so that its lower peripheral edge engages ledge 102 in liquid sealing contact, thereby preventing any liquid in the pump from flowing out into diluting mixture with feed liquid 202. However, upon subsequent flow of drive liquid, domed element 114 is immediately caused to hinge upwardly to open access hole 98 so that feed liquid can flow into the pump and be pumped out as described.

FIGS. 14 to 18 illustrate a modification of the previously described eductor pump. The modification as shown in FIGS. 14 to 18 employs a valve retaining element 130 to secure flapper valve 114 in position in valve-containing plate 80.

Valve retaining element 130 has the general shape of a cap with a tubular wall 132 and a top 134 integrally formed on the end of wall 132. The lower end 136 of wall 132 fits snugly in the part of hole 98 and presses against ring 112 of the valve thereby holding it in place without obstructing displacement of valve domed element 114 when the valve opens and shuts. The lower end 136 of element 130 can be secured in place by an adhesive or binder.

The outer upper end of tubular wall 132 is provided with an annular groove 138 in which O-ring 140 is retained. When the plate 80 is positioned on the pump by screws 82 as described above, the valve retaining element 130 slides into the axial bore 55 in a fluid tight manner by means of O-ring 138 contacting the surface of bore 55.

Valve retaining element 130 is provided with a lateral cutout 150 in the middle of wall 132. Cutout 150 is positioned so that liquid which passes through the flapper valve 110 can exit from the interior of valve retaining element 130 and flow into liquid passage 122.

The modification described in conjunction with FIGS. 14 to 18 is presently the preferred embodiment. The element 130 serves not only to hold valve 110 in place but it also appears to facilitate the pumping action, especially when drawing a slurry from container 200.

The described eductor pump can be used to pump many different liquids from a reservoir or container. The feed liquid can contain water or an organic liquid or both. Furthermore, the drive liquid can be water or an organic liquid. In addition the drive liquid need not be soluble or miscible in the feed liquid.

The foregoing detailed description has been given for clearness of understanding only, and no unnecessary limitations should be understood therefrom as modifications will be obvious to those skilled in the art.

What is claimed is:

1. An eductor pump for withdrawing a feed liquid product from a container, comprising:

a tubular body having a converging nozzle mounted inside and near the lower end of the tubular body;

conduit means for feeding a drive liquid to the converging nozzle so that the drive liquid can flow through the converging nozzle and be directed upwardly in the tubular body;

a feed liquid access opening in the lower end of the tubular body and a passageway from said access opening to the upstream side of the converging nozzle whereby feed liquid can be inspirated into upward flow, and admixture with, a stream of drive liquid flowing out of the converging nozzle;

means to remove a mixed stream of feed liquid and drive liquid from the upper part of the tubular body;

a removable plate, having top and bottom surfaces, attached to the lower end of the tubular body;

the plate bottom surface having a planar portion lateral to the plate axis and a planar portion sloped about 15° to 30° from a plane normal to the plate axis;

a hole through the plate communicating with the feed liquid access opening in the tubular body lower end;

a one way valve mounted on the plate to close the hole in the plate; and mechanical fastener means, accessible from outside the pump, removably securing the plate to the lower end of the tubular body so that the plate can be removed and the valve thereon readily replaced.

2. An eductor pump according to claim 1 in which the sloped planar portion intersects the lateral planar portion across the hole.

3. An eductor pump according to claim 1 in which the sloped planar portion has a groove therein extending to the hole so that feed liquid can enter the hole when the lateral planar portion is in substantial contact with a container internal bottom surface.

4. An eductor pump for withdrawing a feed liquid product from a container, comprising:

a tubular body having a converging nozzle mounted inside and near the lower end of the tubular body;

conduit means for feeding a drive liquid to the converging nozzle so that the drive liquid can flow through the converging nozzle and be directed upwardly in the tubular body;

a feed liquid access opening in the lower end of the tubular body and a passageway from said access opening to the upstream side of the converging nozzle whereby feed liquid can be inspirated into upward flow, and admixture with, a stream of drive liquid flowing out of the converging nozzle;

means to remove a mixed stream of feed liquid and drive liquid from the upper part of the tubular body;

a removable plate, having top and bottom surfaces, attached to the lower end of the tubular body;

the plate bottom surface having a planar portion lateral to the plate axis and a planar portion sloped about 15° to 30° from a plane normal to the plate axis;

a hole through the plate communicating with the feed liquid access opening in the tubular body lower end, with said hole having a greater diameter in the upper part than in the lower part of the plate thereby providing a valve supporting ledge in the hole; and a flapper valve mounted in the hole in the plate on the valve supporting ledge.

5. An eductor pump according to claim 4 in which the sloped planar portion intersects the lateral planar portion across the hole.

6. An eductor pump according to claim 4 in which the sloped planar portion has a groove therein extending to the hole so that feed liquid can enter the hole when the lateral planar portion is in substantial contact with a container internal bottom surface.

7. An eductor pump for withdrawing a feed liquid product from a container, comprising:

a tubular body having a converging nozzle mounted inside and near the lower end of the tubular body;

conduit means for feeding a drive liquid to the converging nozzle so that the drive liquid can flow through the converging nozzle and be directed upwardly in the tubular body;

a feed liquid access opening in the lower end of the tubular body and a passageway from said access opening to the upstream side of the converging nozzle whereby feed liquid can be inspirated into upward flow, and admixture with, a stream of drive liquid flowing out of the converging nozzle;

means to remove a mixed stream of feed liquid and drive liquid from the upper part of the tubular body;

a removable plate, having top and bottom surfaces, attached to the lower end of the tubular body;

a hole through the plate communicating with the feed liquid access opening in the tubular body lower end, with said hole having a greater diameter in the upper part than in the lower part of the plate thereby providing a valve supporting ledge in the hole; and a flapper valve mounted in the hole in the plate on the valve supporting ledge;

a valve retaining element mounted on the plate which secures the valve against being removed; and the valve retaining element is positioned on the outlet side of the valve and is in the form of a hollow cap with a sidewall and closed top, and a cutout for fluid flow is located in the cap sidewall in fluid flow communication with the feed liquid passageway.

8. An eductor pump for withdrawing a feed liquid product from a container, comprising:

a tubular body having a converting nozzle mounted inside and near the lower end of the tubular body;

conduit means for feeding a drive liquid to the converging nozzle so that the drive liquid can flow through the converging nozzle and be directed upwardly in the tubular body;

a feed liquid access opening in the lower end of the tubular body and a passageway from said access opening to the upstream side of the converging nozzle whereby feed liquid can be inspirated into upward flow, and admixture with, a stream of drive liquid flowing out of the converging nozzle;

means to remove a mixed stream of feed liquid and drive liquid from the upper part of the tubular body;

a removable plate, having top and bottom surfaces, attached to the lower end of the tubular body;

a hole through the plate communicating with the feed liquid access opening in the tubular body lower end;

a one way valve mounted on the plate to close the hole in the plate;

a valve retaining element positioned on the outlet side of the valve and mounted on, and removable with, the plate and which secures the valve against being removed;

the valve retaining element being in the form of a hollow cap with a sidewall and closed top and a cutout for fluid flow is located in the cap sidewall in fluid flow communication with the feed liquid passageway; and mechanical fastener means, accessible from outside the pump, removably securing the plate to the lower end of the tubular body so that the plate can be removed and the valve thereon readily replaced.

9. An eductor pump for withdrawing a feed liquid from a container, comprising:

a tubular body having a closed lower end;

a cylindrical block, having an axial bore therein, mounted in the lower end of the tubular body;

a converging nozzle element mounted in the cylindrical block bore above a drive liquid inlet in communication with the bore;

a plug means mounted in the cylindrical block bore below the drive liquid inlet in communication with the bore and with the plug means mounted inward of the tubular body closed lower end;

conduit means for feeding a drive liquid to the converging nozzle so that the drive liquid can flow through the converging nozzle and be directed upwardly in the tubular body;

a feed liquid access opening in the closed lower end of the tubular body and a passageway from said access opening to the upstream side of the converging nozzle whereby feed liquid can be inspirated into upward flow, and admixture with, a stream of drive liquid flowing out of the converging nozzle;

means to remove a mixed stream of feed liquid and drive liquid from the upper part of the tubular body;

the tubular body lower end being closed by a removable plate, having top and bottom surfaces, attached to the lower end of the tubular body;

the plate having a hole through it communicating with the feed liquid access opening in the tubular body lower end;

a one way valve mounted to close the hole in the plate; and the plate having a valve retaining element in the form of a hollow cap mounted thereon and positioned on the outlet side of the valve, with said cap having a sidewall with a cutout therein for fluid flow communication with the feed liquid passageway, and the plug means in the cylindrical block bore comprising a closed top of the cap.

* * * * *

UNITED STATES PATENT AND TRADEMARK OFFICE

CERTIFICATE OF CORRECTION

PATENT NO. : 4,505,646

DATED : March 19, 1985

INVENTOR(S) : NATHAN ROY LONG and HOWARD L. ANDERSON

It is certified that error appears in the above-identified patent and that said Letters Patent is hereby corrected as shown below:

In the Abstract, lines 2-3, 5,6,10 and 12 , change "venturi element" to --converging nozzle--; Column 1, line 66, change "element" to --nozzle--; column 3, line 51, delete "p" and start a paragraph with --To--; column 4, line 27, delete "venturi", line 28 before "60" insert --converging nozzle--; column 5, line 20, delete "venturi" and in place thereof insert --converging nozzle--; line 21, delete "venturi" and in place thereof insert --converging nozzle 60--.

Signed and Sealed this

Second Day of July 1985

[SEAL]

*Attest:*

DONALD J. QUIGG

*Attesting Officer* *Acting Commissioner of Patents and Trademarks*